US010837192B2

(12) United States Patent
Moreno et al.

(10) Patent No.: US 10,837,192 B2
(45) Date of Patent: Nov. 17, 2020

(54) SEISMIC ISOLATION SYSTEMS COMPRISING A LOAD-BEARING SURFACE HAVING A POLYMERIC MATERIAL

(71) Applicant: Worksafe Technologies, Valencia, CA (US)

(72) Inventors: Gil A. Moreno, San Clemente, CA (US); Don A. Hubbard, Valencia, CA (US)

(73) Assignee: WORKSAFE TECHNOLOGIES, Valencia, CA (US)

( * ) Notice: Subject to any disclaimer, the term of this patent is extended or adjusted under 35 U.S.C. 154(b) by 0 days.

(21) Appl. No.: 15/615,097

(22) Filed: Jun. 6, 2017

(65) Prior Publication Data

US 2017/0350152 A1 Dec. 7, 2017

Related U.S. Application Data

(60) Provisional application No. 62/346,182, filed on Jun. 6, 2016.

(51) Int. Cl.

| | |
|---|---|
| ***E04H 9/02*** | (2006.01) |
| ***E02D 31/08*** | (2006.01) |
| ***E04B 1/98*** | (2006.01) |

(52) U.S. Cl.

CPC ..... *E04H 9/023* (2013.01); *E02D 31/08* (2013.01); *E04B 1/98* (2013.01); *E02D 2300/0045* (2013.01)

(58) Field of Classification Search

CPC ..... E04H 9/023; E04H 9/021; E04H 9/02; E02D 27/34; E04B 1/98; E01D 19/046

See application file for complete search history.

(56) References Cited

U.S. PATENT DOCUMENTS

| | | | | |
|---|---|---|---|---|
| 2,014,643 A | | 9/1935 | Bakker | |
| 3,592,406 A | * | 7/1971 | Martin | B65H 75/14 242/118.8 |
| 3,606,704 A | | 9/1971 | Denton | |
| 4,371,143 A | | 2/1983 | Ishida et al. | |
| 4,662,133 A | | 5/1987 | Kondo | |
| 4,801,122 A | | 1/1989 | Stahl | |
| 4,899,323 A | * | 2/1990 | Fukahori et al. | 367/176 |
| 4,917,211 A | | 4/1990 | Yamada et al. | |
| 4,922,670 A | | 5/1990 | Naka et al. | |

(Continued)

FOREIGN PATENT DOCUMENTS

WO 2013130975 A1 9/2013

OTHER PUBLICATIONS

Intemarional Search Report and Written Opinion. Application No. PCT/US17/36151, dated Oct. 24, 2017.

*Primary Examiner* — Brian E Glessner
*Assistant Examiner* — Daniel J Kenny
(74) *Attorney, Agent, or Firm* — Carlos A. Fisher; Stout, Uxa & Buyan, LLP

(57) ABSTRACT

A new seismic isolation bearing assembly is disclosed. The assembly includes a first isolation bearing plate, a second isolation bearing plate, and a moveable bearing element disposed between the first and second isolation bearing plates, each of the first and second isolation plates comprises a solid material and a surface facing the other isolation plate comprising a polymeric material different from the solid material. The polymeric material is effective to enhance the operability of the assembly.

20 Claims, 4 Drawing Sheets

(56) References Cited

U.S. PATENT DOCUMENTS

| | | | | |
|---|---|---|---|---|
| 5,599,106 | A | 2/1997 | Kemeny | |
| 5,791,096 | A | 8/1998 | Chen | |
| 5,816,559 | A | 10/1998 | Fujimoto | |
| 5,913,345 | A * | 6/1999 | Corrado | B08B 7/0028 15/3 |
| 6,102,039 | A * | 8/2000 | Springett | B32B 5/26 128/206.12 |
| 6,324,795 | B1 | 12/2001 | Stiles et al. | |
| 7,784,225 | B2 * | 8/2010 | Kemeny | E04H 9/023 52/167.1 |
| 8,061,551 | B2 * | 11/2011 | Matlovich | B65D 25/34 220/737 |
| 8,104,236 | B2 | 1/2012 | Kemeny | |
| 8,156,696 | B2 | 4/2012 | Hubbard et al. | |
| 8,342,752 | B2 | 1/2013 | Moreno et al. | |
| 8,511,004 | B2 | 8/2013 | Hubbard et al. | |
| 8,545,966 | B2 * | 10/2013 | Vito | A63B 59/50 428/167 |
| 8,641,282 | B2 | 2/2014 | Chuang | |
| 2009/0255066 | A1 * | 10/2009 | Brock | A63C 19/10 14/69.5 |
| 2011/0222800 | A1 | 9/2011 | Hubbard et al. | |
| 2013/0119224 | A1 | 5/2013 | Moreno et al. | |
| 2014/0318043 | A1 | 10/2014 | Hao | |
| 2015/0128510 | A1 | 5/2015 | Moreno et al. | |
| 2015/0191881 | A1 | 7/2015 | Kim | |
| 2016/0185268 | A1 * | 6/2016 | Nachtman | B60R 13/01 296/26.02 |
| 2017/0108034 | A1 * | 4/2017 | McGuire | F16C 11/0652 |
| 2019/0162306 | A9 * | 5/2019 | Busby | F16J 15/102 |

* cited by examiner

SEISMIC ISOLATION SYSTEMS COMPRISING A LOAD-BEARING SURFACE HAVING A POLYMERIC MATERIAL

CROSS-REFERENCE TO RELATED APPLICATIONS

This application claims the benefit of U.S. provisional patent application Ser. No. 62/346,182, filed Jun. 6, 2016, which is hereby incorporated by reference herein in its entirety.

BACKGROUND OF THE INVENTION

Although minor earthquakes are common, with thousands of smaller earthquakes occurring daily, larger magnitude seismic events can cause personal injury, death and property and environmental damage, particularly in heavily populated areas.

Two approaches have been traditionally utilized to prevent or limit damage or injury to objects or payloads due to seismic events. In the first approach, used particularly with structures themselves, the objects or payload articles are made strong enough to withstand the largest anticipated earthquake. However, in addition to the relative unpredictability of damage caused by tremors of high magnitude and long duration and of the directionality of shaking, use of this method alone can be quite expensive and is not necessarily suitable for payloads to be housed within a structure. Particularly for delicate, sensitive or easily damaged payload, this approach alone is not especially useful.

In the second approach, the objects are isolated from the vibration such that the objects fail to experience the full force and acceleration of the seismic shock waves. Various methods have been proposed for accomplishing isolation or energy dissipation of a structure or object from seismic tremors, and these methods may depend in some measure on the nature of the object to be isolated.

Thus, buildings and other structures may be isolated using, for example, passive systems, active systems, or hybrid systems. Such systems may include the use of one or more of a torsional beam device, a lead extrusion device, a flexural beam device, a flexural plate device, and a lead-rubber device; these generally involves the use of specialized connectors that deform and yield during an earthquake. The deformation is focused in specialized devices and damage to other parts of the structure are minimized; however the deformed devices often must be repaired or replaced after the seismic event, and are therefore largely suitable for only one use.

Active control systems requite an energy source and computerized control actuators to operate braces or dampers located throughout the structure to be protected. Such active systems are complex, and require service or routine maintenance.

For objects other than buildings, bridges and other structures, isolation platforms or flooring systems may be preferable to such active or deformable devices. Thus, for protection of delicate or sensitive equipment such as manufacturing or processing equipment, laboratory equipment, computer servers and other hardware, optical equipment and the like an isolation system may provide a simpler, effective, and less maintenance-intensive alternative. Isolation systems are designed to decouple the objects to be protected (hereinafter the "payload") from damage due to the seismic ground motion.

Isolators have a variety of designs. Thus, such systems have generally comprised a combination of some or all of the following features: a sliding plate, a support frame slidably mounted on the plate with low friction elements interposed therebetween, a plurality of springs and/or axial guides disposed horizontally between the support frame and the plate, a floor mounted on the support frame through vertically disposed springs, a number of dampers disposed vertically between the support frame and the floor, and/or a latch means to secure the vertical springs during normal use.

Certain disadvantages to such pre-existing systems include the fact that it is difficult to establish the minimum acceleration at which the latch means is released; it is difficult to reset the latch means after the floor has been released; it may be difficult to restore the floor to its original position after it has moved in the horizontal direction; the dissipative or damping force must be recalibrated to each load; there is a danger of rocking on the vertical springs; and since the transverse rigidity of the vertical springs cannot be ignored with regard to the horizontal springs, the establishment of the horizontal springs and an estimate of their effectiveness, are made difficult. Ishida et al., U.S. Pat. No. 4,371,143 have proposed a sliding-type isolation floor that comprises length adjustment means for presetting the minimum acceleration required to initiate the isolation effects of the flooring in part by adjusting the length of the springs.

Yamada et al., U.S. Pat. No. 4,917,211 discloses a sliding type seismic isolator comprising a friction device having an upper friction plate and a lower friction plate, the friction plates having a characteristic of Coulomb friction, and horizontally placed springs which reduce a relative displacement and a residual displacement to under a desired value. The upper friction plate comprises a material impregnated with oil, while a lower friction plate comprises a hard chromium or nickel plate.

Stahl (U.S. Pat. No. 4,801,122) discloses a seismic isolator for protecting e.g., art objects, instruments, cases or projecting housing comprising a base plate connected to a floor and a frame. A moving pivoted lever is connected to a spring in the frame and to the base plate. The object is placed on top of the frame. Movement of the foundation and base plate relative to the frame and object causes compression of the lever and extension of the spring, which then exerts a restoring force through a cable anchored to the base plate; initial resistance to inertia is caused due to friction between the base plate and the frame.

Kondo et al., U.S. Pat. No. 4,662,133 describes a floor system for seismic isolation of objects placed thereupon comprising a floor disposed above a foundation, a plurality of support members for supporting the floor in a manner that permits the movement of the floor relative to the foundation in a horizontal direction, and a number of restoring devices comprising springs disposed between the foundation and the floor member. The restoring members comprise two pair of slidable members, each pair of slidable members being movable towards and away from each other wherein each pair of slidable members is disposed at right angles from each other in the horizontal plane. Stiles et al., U.S. Pat. No. 6,324,795 disclose a seismic isolation system between a floor and a foundation comprising a plurality of ball and socket joints disposed between a floor and a plurality of foundation pads or piers. In this isolation device, the bearing comprises a movable joint attached to a hardened elastomeric material (or a spring); the elastic material is attached on an upper surface of the ball and socket joint and thus sandwiched between the floor and the ball and socket joint; the bearing thus tilts in relation to the floor in response to vertical movement. The floor is therefore able to adjust to buckling pressure due to distortion of the ground beneath the foundation piers. However, the device disclosed is not designed to move horizontally in an acceleration-resisting manner.

Fujimoto, U.S. Pat. No. 5,816,559 discloses a seismic isolation device quite similar to that of Kondo, as well as various other devices including one in which a rolling ball is disposed within the tip of a strut projecting downward from the floor in a manner similar to that of a ball point pen.

Bakker, U.S. Pat. No. 2,014,643, is drawn to a balance block for buildings comprising opposed inner concave surfaces with a bearing ball positioned between the surfaces to support the weight of a building superstructure.

Kemeny, U.S. Pat. No. 5,599,106 discloses ball-in-cone bearings.

Kemeny, U.S. Pat. Nos. 7,784,225 and 8,104,236 discloses seismic isolation platforms containing rolling ball isolation bearings.

Hubbard and Moreno, U.S. Pat. Nos. 8,156,696 and 8,511,004 discloses apparatus and methods involving raised access flooring structure for isolation of a payload placed thereupon.

Moreno and Hubbard, U.S. Pat. No. 8,342,752 disclose isolation bearing restraint devices.

Isolation bearings are disclosed in Hubbard and Moreno, U.S. Patent Publication US 2013/0119224 filed on Sep. 25, 2012.

Moreno and Hubbard, U.S. Patent Publication No. U.S. 2011/0222800 disclose methods and compositions for isolating a payload from vibration.

Hubbard and Moreno, U.S. Provisional Patent Applications No. 62/079,475, 62/262,816 and 62/335,203 describe seismic isolation of container transport and storage systems.

Chen, U.S. Pat. No. 5,791,096 discloses a raised floor system.

Denton, U.S. Pat. No. 3,606,704 discloses an elevated floor structure suitable for missile launching installations with vertically compressible spring units to accommodate vertical displacements of the subfloor.

Naka, U.S. Pat. No. 4,922,670 is drawn to a raised double flooring structure which is resistant to deformation under load. The floor employs columnar leg members that contain a pivot mounting near the floor surface, which permits to floor to disperse a load in response to a side load.

All patents, patent applications and other publications cited in this patent application are hereby individually incorporated by reference in their entirety as part of this disclosure, regardless whether any specific citation is expressly indicated as incorporated by reference or not.

SUMMARY OF THE INVENTION

The present invention is directed to new seismic isolation systems. The present systems are effective in providing one or more operational benefits, for example, relative to the past systems. Such benefits are advantageously achieved in a straightforward manner, for example, without major structural changes to the past isolation systems.

The present invention may be involved, or used in conjunction with a wide variety of "rolling member"-type seismic isolation bearings.

Although not exclusively, in some examples the invention may involve, or may be used in conjunction with, a "low rise" platform or flooring system such as that disclosed in International Patent Application No. PCT/US2013/028621, filed on Mar. 1, 2013.

In some examples, the invention may involve, or be used in conjunction with a raised isolation flooring system such as, without limitation, systems such as the ones disclosed by U.S. Pat. Nos. 8,156,696 and 8,511,004. In other examples the invention may involve, or be used in conjunction with, seismic isolation platforms such as, without limitation, those disclosed in U.S. Pat. Nos. 7,784,225 and 8,104,236.

In other examples the invention may involve, or be used in conjunction with, isolation bearings such as, without limitation, those disclosed in U.S. Pat. No. 5,599,106.

Isolation bearings and systems such as, without limitation, those disclosed in e.g., U.S. Pat. Nos. 5,599,106; 7,784,225; 8,104,236; 8,156,696 and 8,511,004 provide seismic isolation through the utilization of isolation bearings comprising at least one (and usually two) horizontally extending bearing plate(s) each with an indented, generally concave (e.g., partly spherical conical) surface. A cross-sectional profile through a midline vertical axis of such a bearing plate shows that the generally concave surface comprises a shape, generally symmetrical around a central vertical axis. This shape may comprise a substantially conical shape, a substantially spherical shape, or a shape, comprising a linked combination of linear and radial shapes. When the generally concave surface of the bearing plate is a top surface of the bearing plate the bearing plate shall be considered "upward" facing, whereas when this surface is the bottom surface of the bearing plate, the concave surface shall be considered "downward" facing.

Generally at least one bearing plate supports, or is supported by a rolling member. By "rolling member" is meant one or more roller or bearing which is positioned between two, preferably identical, load-bearing surfaces of opposing bearing plates, and supports and isolates a payload from seismic vibration via a rolling movement permitting the opposing bearing plates to dislocate in approximately parallel plates with respect to each other during a seismic vibration. Examples of rolling members include, for example and without limitation, a sphere or rolling ball, such as a ball bearing, or one or more rolling rods, such as one or more roller. In preferred rolling ball isolation bearing systems a rolling ball is between opposing upward-facing and downward-facing isolation bearing plates in such a manner that when a seismic event occurs, horizontal ground movement of the floor or foundation is isolated from the payload supported by the isolation bearings. Horizontal ground movement of the lower bearing plate is attenuated by the inertia of the payload mass on the upper bearing plate so that the rolling member, located at rest in the center of the bearing plates, is free to move out of the center of the lower plate as the plate moves under it. The rolling member(s) may permit the upper plate to move in any direction (relative to the lower plate) opposite to the direction of lower plate movement due to seismic activity.

A major advantage to such a rolling member is that, since it is substantially equally free to move the same distance in any horizontal direction (i.e., along the x and y axes) given a constant force, the bearing does not require additional means to translate and isolate non-linear forces, or forces having both x and y components, as is necessary with isolation equipment using only one or more unidirectional rollers, springs, skids or the like as the primary means of isolating the payload. Additionally, because of the use of a generally concave, generally symmetrical bearing surface, the bearing is "self-initializing", with the rolling member returning to the center of the bearing plate following a seismic tremor, thus restoring the rolling member to its initial resting position.

One disadvantage that has been noted with regard to the movement of the rolling member (e.g., ball, roller, etc.) relative to the bearing plate(s) is the tendency for the rolling member to skip, slide or skid relative to the plate or plates. This type of uneven movement or action between the rolling member and the plate or plates results (or can result) in the isolation system being slow to react (or even note reacting) in response to events (seismic events) in which a smooth, consistent response by the system is advantageous or even required.

The present invention is directed to methods and apparatus which involve improved seismic isolation bearings and systems utilizing such seismic isolation bearings, as well as methods of making and using such bearings and systems. In particular examples, the present invention involves seismic isolation systems utilizing one or more "rolling ball" or other "rolling member" (roller) isolation bearing comprising a bearing plate, for example, a bearing plate made of metal, i.e., a metallic bearing plate, for example, having a polygonal shape. That is, the isolation bearing comprises at least one payload-supporting "pan" or bearing plate assembly (plate plus optional frame) having a polygonal shape in a plan view comprising a load-bearing surface having a cross-sectional profile comprising a generally conical shape, a generally spherical shape, or a shape, generally symmetrical around a central vertical axis, comprising a linked combination of linear and radial shapes.

In one aspect, the present invention is directed to a seismic isolation bearing assembly comprising a first isolation bearing plate; a second isolation bearing plate; and a ball or other rolling member between the first and second isolation bearing plate, each of the first and second isolation plates comprises a hard material, advantageously a metal or metal alloy, and a surface facing the other isolation plate coated with, or otherwise comprising, a polymeric material different from the hard material.

The polymeric material may comprise an organic polymeric component, for example, a polymeric material effective to enhance the operability of the assembly relative to the assembly without the polymeric material. For example, the present assembly may provide at least one of (1) increased operational smoothness, (2) increased operational safety, (3) increased operation efficiency, (4) increased operational reliability, (3) increased ability to "grip" the rolling member, such as through adhesiveness, through a charge opposite that of the surface of the rolling member, hydrophilic/hydrophobic interactions, micro-mechanical means, or otherwise, and (5) reduced incidence of bearing assembly failure relative to a substantially identical bearing assembly without an isolation bearing assembly the polymeric material.

The polymeric material may comprise any suitable, e.g., effective, such material. The polymeric material advantageously is such that it can be effectively applied to the load bearing surfaces of the isolation plates and remain on such load bearing surfaces to reduce or even eliminate sliding, skipping and/or stopping of the rolling ball and other or roller bearing relative to the isolation barrier plates. The polymeric material on the facing surfaces of the isolation plates is effective to provide more consistent and responsive movement of the rolling member relative to the relative movement of the isolation barrier plates.

The amount of the polymeric material placed on the load bearing surfaces of the isolation barrier plates is sufficient to be effective in reducing or even eliminating such skipping and/or stopping of the ball bearing or roller bearing relative to the isolation barrier plates.

Such amount of the polymeric material, expressed in terms of thickness on the surface of the isolation barrier plates may range from about 0.01 or about 0.03 or about 0.05 inches to about 0.1 or about 0.15 or about 0.25 inches. The thickness of the polymeric material may vary depending on the specific application or polymer involved, the specific isolation bearing plates and rolling member(s) being used and the specific conditions to which the polymeric material is to be exposed.

The polymeric material may be any polymeric material which, when placed on the isolation plates is effective to reduce the sliding, skipping and/or stopping of the rolling member relative to the isolation plates.

The polymeric material may be placed on the surface of an isolation plate as a liquid, a liquid/solid slurry or other useful form. The polymer may also be formed on the surface of the isolation plates, for example, by providing a reactant, or a mixture of reactants on the surface of the isolation plates and allowing the polymer coating to form, for example, by evaporation of the liquid or chemical reaction of the reactants on the surface.

In other examples, the isolation plate surface may be fabricated with a polymeric surface, such as by molding (e.g., injection molding) or extrusion, such as by extrusion of a polymeric coating on the load-bearing surface of the isolation plate or other part.

The polymeric material chosen should be effective at the conditions of use of the isolation plates. For example, polymeric materials advantageously should not melt or decompose or otherwise become ineffective at conditions to which the isolation plates are exposed during use.

The polymeric material advantageously is useful on the isolation plates for at least about 5 years or about 10 years or for the useful life of the isolation plates.

The polymeric material may comprise hydrocarbon-containing polymers, non-hydrocarbon polymers, for example, silicone polymers, and/or mixtures of two or more polymers.

In short, any polymeric material or combination of polymeric materials which are useful and effective to prevent (or retard) sliding, skipping, skidding and/or stopping of rolling members relative to surfaces of isolation plates may be employed in accordance with the present invention.

In one example, the polymeric material employed provides a degree of stickiness or tackiness, for example, a slight degree of stickiness or tackiness, to the treated surfaces of the isolation plates. Such sticky or tacky isolation plate surfaces have a beneficial effect of at least assisting in reducing or preventing skipping, skidding and/or stopping of the rolling members relative to the treated surfaces of the isolation plates.

One class of useful polymeric materials are urea-containing polymers, for example, a polymeric material comprising polyurea.

Other polymeric materials may also be useful in providing an effective coating on the surfaces, e.g., load-bearing surfaces, of the isolation bearing plates. Examples of such other polymers include, without limitation, other urea-containing polymers (copolymers); polyurethanes, polyolefins, polyacrylates, polyacrylonitrile, polyamides, polycarbonates, polyester resins, polyethylene, polyglycols, polyisocyanates, polymethacrylates, polymethacrylonitrile, poly (methyl acrylate), poly(methyl methacrylate), poly(α-methyl styrene), other hydrocarbon-based polymers, non-hydrocarbon-based polymers, sulfonated copolymers of ethylene and propylene, sulfonated ter-polymers of ethylene, propylene and a diene, sulfo butyl rubber, sulfo isoprene/styrene rubber, sulfo isoprene/butadiene rubber, sulfo isoprene/butadiene/styrene copolymers, sulfo isobutylene/styrene copolymers, sulfo isobutylene/para methyl styrene copolymers, and complexes of the aforementioned polymers with a vinyl pyridine co-polymer, combinations thereof and the like, which are effective in coating surfaces of isolation bearing plates to eliminate or retard sliding, skipping, skidding and/or stopping of a rolling member relative to the treated surfaces of the isolation barrier plates in a seismic isolation bearing assembly.

It may be advantageous to treat the surface of the bearing plate on which the polymeric material is to be placed to enhance the adhesion of the polymeric material to the plate surface on which the polymeric material is to be placed. For example, this plate surface may be roughened, e.g., sand blasted, or otherwise treated to increase the surface area and provide a non-smooth or roughened texture to the plate surface, relative to the original or non-treated plate surface, so that the polymeric material more strongly adheres, or is more strongly secured, to the plate surface relative to the non-treated plate surface. The thickness of the coating on the load-bearing surface of the isolation bearing is preferable in the range from about 0.5 mm to about 5 mm, or about 0.75 mm to about 3 mm, or about 1 mm to about 2 mm, or about 1.5 mm.

Seismic bearing plates having a surface wholly or partly treated with such a polymeric material may comprise part of any suitable seismic isolation bearing assembly. Without limiting the scope of the invention, examples of suitable seismic bearing assemblies may include the following.

In one example, the seismic isolation bearing assembly may be located in a seismic flooring or platform system and may comprise at least two opposing bearing plates, separated by a rigid or hard bearing element, e.g., a ball, such as a metallic ball bearing, or a roller, e.g., such as a metallic roller bearing. The rigid or hard bearing elements of two or more such assemblies may support the payload upon a frame, flooring element, or platform.

In particularly preferred examples a seismic isolation bearing comprised in a seismic flooring or platform system comprises two bearing plates, separated by a rigid bearing element. In such arrangements an upper bearing plate may be joined to a frame, flooring element, or platform, while a lower bearing plate may be placed upon or affixed to a floor, foundation, frame, or other similar support surface. A lower bearing plate may be oriented "upward", so that when the system is at rest the rigid ball is nested at a central point on the bearing surface of the lower bearing plate. An upper bearing plate may be oriented "downward", so that when the system is at rest the rigid ball rests within a central point on the bearing surface of the upper bearing plate.

In one example, at least a lower bearing plate comprises a polygonal outline shape other than a rectangle in a plan view. A polygonal shape, for example (but not necessarily) an octagonal shape, may be employed and can add to the stability of the seismic isolation system in at least two ways.

First, polygonal seismic isolation bearings may be assembled so that straight sides of the upper and/or lower polygonal bearing plates of at least two adjoining upper or lower isolation bearings may be joined or linked together, thereby reinforcing the stability of these bearings during a seismic event. In certain examples, a single upper or lower polygonal bearing plate may be joined to more than one adjoining bearing plate and/or to a flooring, frame, or platform element. Furthermore, when three or more isolation bearings are used in a single platform or flooring system, the frame, platform and/or flooring elements and the bearings may thus be linked together into a single reinforced structure or network in which the entire upper and/or lower bearing element array is locked together as one.

Secondly, the polygonal shape may facilitate linking the bearing plates to the frame, platform and/or flooring elements. For example, a circular isolation bearing plate has only one point (the point of tangency) at which it makes contact with a straight-edged surface. Thus, even in cases in which upper and/or lower polygonal bearing plates are not linked to each other, the joint between framing, platform, and/or flooring element and the bearing plate is made much more strong and firm when a straight edged segment of the perimeter of the bearing plate (or the bearing plate frame) is joined to a straight segment of such element.

Each of these advantages make the manufacture and assembly of seismic isolation systems comprising polygonal isolation bearings substantially easier than systems employing circular isolation bearings. Due to the straight edges of the isolation bearing plates of the present invention, seismic isolation systems can be designed to fit together more strongly and precisely than those having circular bearing plates.

Furthermore, when an isolation system employs an array of three or more, or four or more, or five or more, or six or more, isolation bearings having the same or complementary polygonal shapes, these bearings can be arranged in various ways depending on factors including, without limitation, the payload location, size, mass, and the size and/or and shape of the space in which the seismic isolation system is to be installed, in order to optimally support the load or conform with space limitations.

The polygonal bearing plates of the present invention may either be manufactured as circular bearing plates with a polygonal "frame" joined thereto by, for example, welds, appropriate fasteners (such as screws, bolts and the like). In another example, the polygonal bearing plates may be manufactured as a polygon, again, preferably surrounded by a polygonal frame.

It will be understood that the polygonal frames, bearing plates and the like may have rounded or "radiused" corners without departing from the scope of the invention. Thus the term "polygonal" or "polygon" shall be interpreted to mean "generally polygonal"; that is, comprising at least two (and preferably at least three) straight sides wherein the sum of all curves and angles totals 360°. In some cases, "polygonal" may mean any polygonal shape other than a rectangle.

The use of polygonal bearing plates greatly facilitates the manufacture and assembly of seismic isolation systems. For example, connector components can be fabricated easily of, for example, metal tubing, flat plates, or angle iron with standardized placement of connection fittings such as (without limitation) screw or bolt holes, or brackets, for being joined to the polygonal bearing plate(s) and/or framing, flooring or platform elements. These connector component/bearing plate assemblies can thus be extended for the desired length or width of the isolation system, with the length of connectors and number of bearing plates being determined, at least in part, by the anticipated mass of the payload. In particular, examples each of opposing sets of polygonal top and bottom bearing plates are linked by, and joined to, connector components to form top and bottom flooring or platform assemblies. Additionally, or alternatively, two or more adjacent polygonal top and/or bottom bearing plates may be joined to each other to form a strong and rigid isolation assembly.

In other possible configurations, the top and/or bottom isolation assembly may be constructed without the use of separate connector components. For example, the polygonal shape of the seismic bearing plates may facilitate directly joining one bearing plate to at least one adjacent bearing plate, which is joined, in turn, to at least one additional bearing plate to form a firm, mutually stabilized structure.

One or more of the bottom bearing plates may also be directly or indirectly joined to a foundation or floor. For example, one or more bearing plate may be fastened directly to the foundation using, for example, concrete anchored fasteners or an adhesive for fastening plastics or metals to concrete, such as the 3M Scotch-Weld® brands of urethane, acrylic and epoxy adhesives.

One or more of the top bearing plates are preferably directly or indirectly fastened to a platform or flooring element. For example, a top bearing plate may be fastened directly to one or more flooring support "tile" or region using bolts, screws or other similar fasteners, or may be joined to a frame for supporting the payload, bearing plate, or tiles.

In one example, the present invention is drawn to a polygonal seismic isolation bearing plate comprising:

a) a recessed hardened load-bearing surface component; and, b) a hardened frame component, sufficiently strong to support said load-bearing surface component during use in an isolation platform or flooring system during an earthquake, said frame component being directly or indirectly joined to said load-bearing surface component; wherein, in top view, the frame component comprises a polygonal shape, for example, other than a rectangle, and wherein said frame component is structured to be joined along at least one straight edge to at least one other component of said isolation platform or flooring system.

In such a system the load-bearing surface component may be welded or otherwise securely joined to a circumferential ring (for this purpose considered part of the load-bearing surface), which can then be joined to a frame component, or may be joined directly to the frame component. The frame component is preferably polygonal in shape, and is structured to be joined to other bearing plate assemblies, or to other components of the isolation flooring or platform assembly. In a particularly preferred embodiment the polygonal shape is not a square, or not a rectangle.

In another example, the invention is drawn to a polygonal seismic isolation bearing assembly comprising:

a) a hardened ball disposed between b) a top isolation bearing plate, and c) a bottom isolation bearing plate;

wherein each said top and bottom isolation bearing plates comprise:

i) a recessed hardened load-bearing surface component; and, ii) a hardened frame component, sufficiently strong to support said load-bearing surface component during use in an isolation platform or flooring system during an earthquake, said frame component being directly or indirectly joined to said load-bearing surface component; wherein, in top view, the frame component comprises a polygonal shape, and wherein said frame component is structured to be joined along at least one straight edge to at least one other component of said isolation platform or flooring system.

Preferably the frame element of one or both of the top bearing plate or the bottom bearing plate is welded or otherwise joined to its respective load-bearing surface component. As above, the frame component is preferably polygonal in shape, and is structured to be joined to other bearing plate assemblies, or to other components of the isolation flooring or platform assembly. In a particularly preferred embodiment the polygonal shape is not a square, or not a rectangle.

Additionally, either or both the top and bottom isolation bearing plates may be directly or indirectly joined to one or more other isolation bearing plate(s) in substantially the same plane. An example of indirect joining is by each bearing plate in substantially the same plane being joined to the same connector component. Another example of indirect joining is by each bearing plate in substantially the same plane being joined to a common flooring or platform component.

In another example, the present invention is directed to a seismic isolation floor or platform assembly comprising a plurality of polygonal isolation bearing assemblies, each such bearing assembly comprising:

a) a hardened ball disposed between b) a top isolation bearing plate, and c) a bottom isolation bearing plate;

wherein each said top and bottom isolation bearing plates comprise:

i) a recessed hardened load-bearing surface component; and, ii) a hardened frame component, sufficiently strong to support said load-bearing surface component during use in an isolation platform or flooring system during an earthquake, said frame component being directly or indirectly joined to said load-bearing surface component; wherein, in top view, the frame component comprises a polygonal shape, and wherein said frame component is structured to be joined along at least one straight edge to at least one other component of said isolation platform or flooring system.

In the seismic isolation floor or platform assembly at least two of said plurality of polygonal isolation bearing assemblies may be joined in a manner selected from the group consisting of:

i) said top isolation bearing plates are directly or indirectly joined together, or ii) said bottom isolation bearing plates are directly or indirectly joined together, or iii) both said top isolation bearing plates are directly or indirectly joined together and said bottom isolation bearing plates are directly or indirectly joined together.

It will be understood that although currently preferred examples of the invention may be used in conjunction with, or as part of, a polygonal seismic isolation system, the scope of the invention is not limited by these examples. Thus a polymeric coating on the load-bearing surfaces of isolation floors, "low rise" isolation systems (in which the lower bearing is mounted in or below the floor or foundation, and any other rolling member isolation system whether using traditional circular isolation bearings or the polygonal bearings disclosed herein.

The inventions shall now be described by detailing specific, non-limiting drawings and examples.

DETAILED DESCRIPTION OF THE INVENTION

Figure 1:
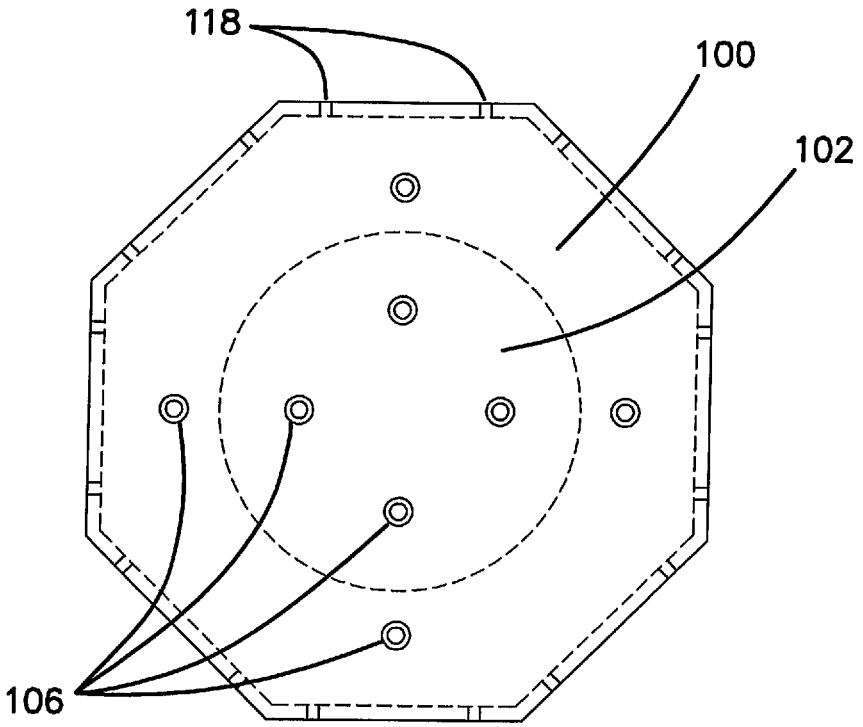
FIG. 1 shows one example of a finished polygonal (octagonal) isolation bearing plate of the present invention.
Figure 2:
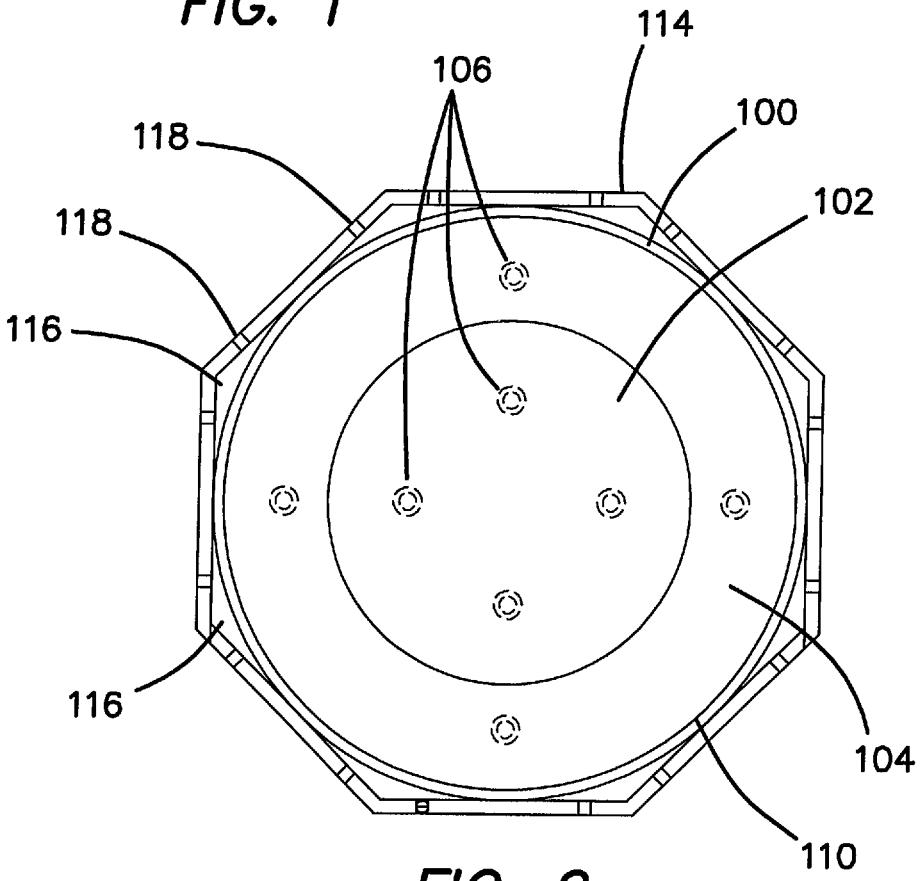
FIG. 2 shows an intermediate stage in the fabrication of the polygonal (octagonal) isolation bearing plate of FIG. 1, showing certain of the components.
Figure 3:
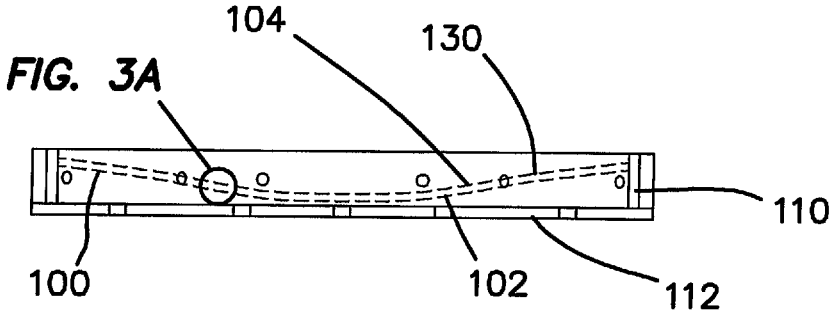
FIG. 3 shows a cross sectional view of a polygonal (octagonal) isolation bearing plate of FIG. 1.

Referring now to the drawings, FIG. 1 shows one example of a finished polygonal bearing plate of the present invention, showing rear fastener holes, while FIG. 2 shows the load-bearing surfaces of the same bearing plate. FIG. 3 is a cross section of the bearing plate of FIG. 1.

In this example, the load-bearing surface component 100 is preferably fashioned from a metal (such as stainless steel) as a circular, symmetrical item, having a central area 102 comprising a radius in cross section; see FIG. 3. Surrounding this central area is a annular area comprising a region of constant slope 104. The bearing surface in this example is drilled and tapped with screw holes 106 for later securing of the bearing plate to an underlying or overlaying surface, if desired. The load-bearing surface 100 is welded to a circular steel band 110 and a flat bottom plate 112; this assembly is then joined, for example welded, to a frame component 114 comprising lengths of a hardened material (cold rolled steel ("CRS") in this case) formed, for example, by welding, into an octagon. As shown, each side of the frame is drilled and tapped 118 for joining to, for example, framing or connector components or other bearing plates with screws or bolts.

The assembly shown in FIG. 2 comprises eight spaces 116 (appearing substantially as triangles in the two dimensional top view of FIG. 2) between the steel band 110 and the frame component 114. Filler pieces of metal are then welded to the assembly to fill in the spaces.

Figure 3A:
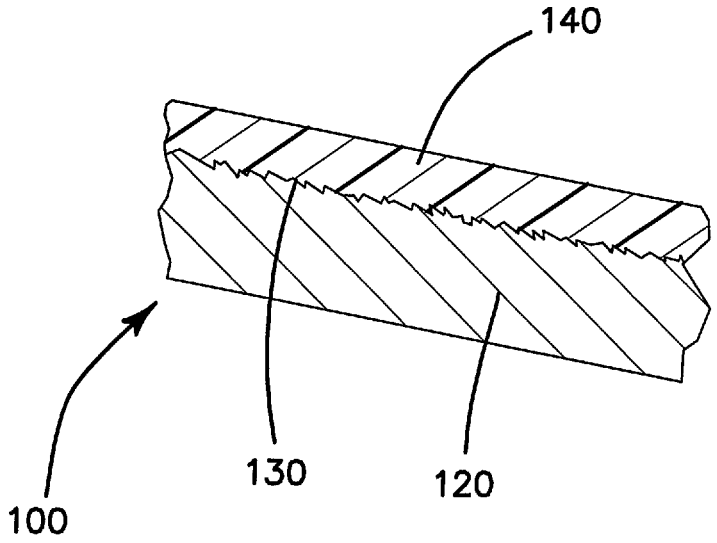
FIG. 3A is an enlarged cross-sectional view of a portion of the isolation bearing plate, shown as "3A" in FIG. 3, showing this portion of the isolation bearing plate in more detail.

As shown in FIGS. 3 and 3A, load bearing surface 100 includes a sandblasted upper surface 130 which is coated with a polyurea top coating 140.

This structure is produced by sandblasting the upper (top) portion 120 of at least the load bearing surface 100 so that the resulting sandblasted surface 130 is roughened. See FIG. 3A. When a polyurea composition is applied to this roughened surface, for example, as a liquid, dry, or flowable material, the polyurea material 140, after being allowed to cure, set or solidify, as in the form of a film or layer and securely adheres to or is held to the roughened surface 130. The film or layer of polyurea material may be slightly sticky or tacky.

The polyurea material film or layer 140 is sufficiently thick to be wear resistant and to remain in place and effective, for example, to avoid or reduce sliding, skidding and/or stopping of the rolling member which is placed between bearing surface 100 and a complementary bearing facing the upper surface (140) of bearing 100. As noted elsewhere in this application, reducing or eliminating such skidding and/or stopping, provides substantial advantages.

In other examples surfaces other than the load-bearing surfaces alone of the seismic isolation bearing may be coated with the polymeric coating. For example, the entire seismic isolation bearing may be so coated.

For example, the entire isolation bearing may be sandblasted, then with a polyuria coating.

The coating may be applied by spraying the polymer onto the surface, for example, onto a sandblasted surface. An advantage of polyurea polymers such as the two-component isocyanate/resin polyurea system sold as Rhino Extreme™, 11-50 GT. The isocyanate and resin are sprayed using high pressure plural component spray equipment. The coating is 100% solids, no VOC's and no solvents, is chemically resistant, and has high tensile, tear, and elongation properties. It has a hardness (Shore D) of about 45 to 55, tensile strength of about 2800-3200 psi, tear resistance of about 500-600 pli, and a percent elongation of about 400-500.

Figure 4:
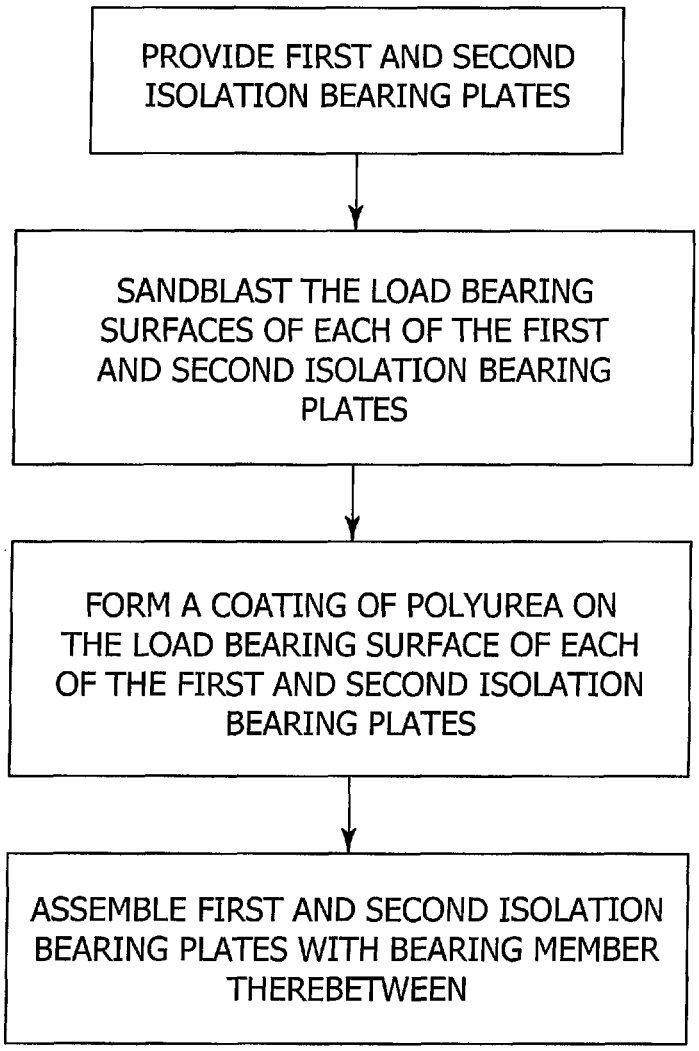
FIG. 4 is a block diagram setting forth steps to provide the isolation bearing plate of FIGS. 3 and 3A in accordance with the present invention.

FIG. 4 is a block diagram setting forth steps to provide the isolation bearing plate of FIGS. 3 and 3A in accordance with the present invention.

Figure 5:
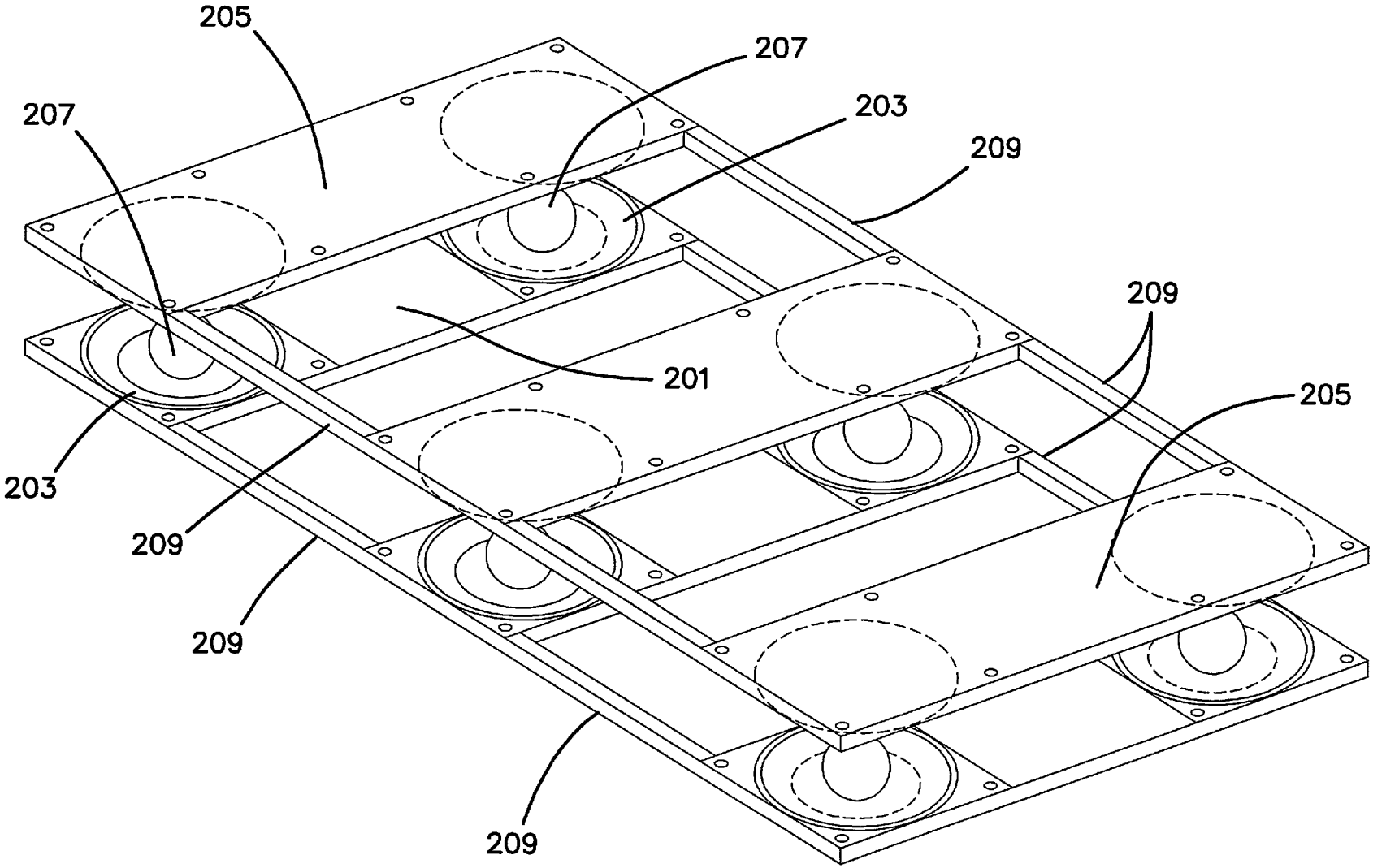
FIG. 5 is a diagram of one embodiment of the present invention.

FIG. 5 shows one embodiment of the present invention. This embodiment depicts a substantially flat, generally planar lower pan segment 201 having a first side, and a second side opposite the first side having at least two upward facing recesses 203. A substantially flat, generally planar upper pan segment 205 has a first side, and a second side opposite the first side having at least two downward-facing recesses structured to oppose the upward-facing recesses 203. The opposing recesses are aligned to define at least two cavities therebetween, each cavity containing at least one rigid ball 207 rollably supporting the upper pan segment 205 upon the lower pan segment 201. A cross-section passing through the center of at least one recess defines a line along the surface of the recess comprising a combination of shapes selected from the group consisting of: i) a straight line and a curve, ii) a first curve and a second curve different from the first curve, and iii) a first straight line and a second straight line having a different slope than the first straight line. Each such isolation platform is structured to be linked to at least one additional isolation platform using a plurality of rigid connecting members 209 linking contiguous upper pan segments 205 and contiguous lower pan segments 201.

The first and second isolation bearing plates are provided. Such plates can be conventional in size, shape and structure. Such plates are often made of hardened materials, such as steel and/or other metals.

The load bearing surfaces of each of the first and second isolation bearing plates are sandblasted, or otherwise roughened, so that a coating can be placed on, and remain on, the load bearing surfaces of the isolation bearing plates. After such surface treatment/preparation, the load bearing surfaces of both the first and second isolation bearing plates are contacted with a polymeric material, such as polyurea, to form a coating of the polymer on the load bearing surfaces of the first and second isolation bearing plates.

The first and second isolation bearing plates are assembled with a bearing member, e.g., ball, roller and the like, therebetween so that the bearing member comes into contact with the coating on the first and second isolation bearing plates, thereby reducing skidding and/or stopping of the ball or roller during operation. Such reduced skidding and/or stopping during operation results in improved operational efficiencies of the seismic isolation bearing assembly. Put another way, placing a polymeric coating on load-bearing surfaces of the first and second bearing plates, in accordance with the present invention, provides substantial benefits with regard to the operation of the seismic isolation bearing assembly relative to such an assembly without the polymeric coating on the first and second bearing plates.

The surface treatment or roughening, e.g., sandblasting, of the load bearing surfaces is effective in holding or maintaining the polymeric material coatings in place on the first and second bearing plates so that the coatings are maintained on the load bearing surfaces and are effective for longer periods of time to improve the operation of the assembly.

Although the foregoing invention has been exemplified and otherwise described in detail for purposes of clarity of understanding, it will be clear that modifications, substitutions, and rearrangements to the explicit descriptions may be practiced within the scope of the appended claims. For example, the inventions described in this specification can be practiced within elements of, or in combination with, other any features, elements, methods or structures described herein. Additionally, features illustrated herein as being present in a particular example are intended, in other aspects of the present invention, to be explicitly lacking from the invention, or combinable with features described elsewhere in this patent application, in a manner not otherwise illustrated in this patent application or present in that particular example. The language of the claims shall solely define the invention. All publications and patent documents cited herein are hereby incorporated by reference in their entirety for all purposes to the same extent as if each were so individually denoted.

What is claimed is:

1. A seismic isolation bearing assembly comprising:

a first isolation bearing plate;

a second isolation bearing plate; and a moveable bearing element disposed between the first and second isolation bearing plates, each of the first and second isolation plates comprises a solid material and a surface facing the other isolation plate comprising a polymeric material different from the solid material, said polymeric material being tacky and causing a reduction in sliding, stopping, and/or skipping of the movable bearing element as it moves across the surfaces of the first and second isolation plates, wherein the polymeric material comprises a 100% polyurea polymer, has a hardness (Shore D) of about 45-55, a tensile strength of about 2800-3200 pounds per square inch (psi), a tear resistance of about 500-600 pounds per linear inch (pli) and a percent elongation of about 400-500, and said polymeric material has a thickness in the range from about 0.5 mm to about 5 mm and is sufficiently durable to have a useful life on the isolation bearing plates selected from the group consisting of a) about 5 years and b) greater than about 5 years.

2. The assembly of claim 1, wherein the solid material comprises a metal.

3. The assembly of claim 1, wherein the polymeric material is effective to enhance the operability of the assembly relative to the assembly without the polymeric material.

4. The assembly of claim 1 which provides at least one of (1) increased operational smoothness, (2) increased operational safety, (3) increased operation efficiency, (4) increased operational reliability, and (5) reduced incidence of bearing assembly failure; each of (1) through (5) being relative to a substantially identical bearing assembly without the polymeric material.

5. The assembly of claim 1, wherein the polymeric material consists essentially of a 100% polyurea polymer.

6. The assembly of claim 1, wherein the first and second isolation barrier plates each includes a roughened or textured surface on which the polymeric material is located.

7. The assembly of claim 1, wherein the first and second isolation bearing plates each includes a sandblasted surface on which the polymeric material is located.

8. The assembly of claim 1, wherein at least one of the first and second bearing plates includes a surface facing the moveable bearing element which varies in at least one of angle and curvature over the extent of the surface.

9. The assembly of claim 1, wherein at least one of the first and second bearing plates includes a first surface portion which is substantially linear in a vertical plane passing through the center of the bearing plate.

10. The assembly of claim 1, wherein at least one of the first and second bearing plates includes a first surface portion which is curved in a vertical plane passing through the center of the bearing plate.

11. The assembly of claim 1, wherein at least one of the first and second bearing plates includes a first surface portion which is substantially linear in a vertical plane passing through the center of the bearing plate, and a second surface portion which is curved in a vertical plane passing through the center of the bearing plate.

12. The assembly of claim 1, wherein the first and second isolation bearing plates each have an outer polygonal periphery; include a recessed hardened load-bearing surface component; and a hardened frame component sufficiently strong to support the recessed hardened load-bearing surface component.

13. The assembly of claim 12, wherein said frame component is welded to said load-bearing surface component.

14. The assembly of claim 13, wherein the load-bearing surface component has a cross sectional profile in a vertical plane passing through the center of the load-bearing surface component comprising a shape selected from the group consisting of:

i) a combination of linear and curved shapes;

ii) a combination of different linear shapes; and iii) a combination of different curved shapes.

15. The assembly of claim 12, wherein the polygonal periphery is an octagonal periphery.

16. The assembly of claim 12, wherein the frame component comprises a series of holes useful in joining the frame component to at least one other component of said isolation platform or flooring system.

17. The assembly of claim 16, wherein the at least one other component is selected from the group consisting of:

i) another isolation bearing plate;

ii) a connecting component;

iii) a frame element of said isolation platform or flooring system; and iv) a floor or foundation.

18. The assembly of claim 12, wherein said load bearing surface component has a substantially circular shape in a top view.

19. The assembly of claim 12, wherein said load bearing surface component has a substantially polygonal shape in a top view.

20. A seismic isolation bearing assembly comprising:

a first isolation bearing plate;

a second isolation bearing plate; and a moveable bearing element disposed between the first and second isolation bearing plates, wherein at least one of the first and second isolation plates comprises a solid material and a surface facing the other isolation plate comprising a coating from about 0.5 mm to about 5 mm thick comprising a polymeric material different from and bonded to the solid material of said at least one of the first and second isolation plates, wherein the polymeric material comprises a polyurea polymer, said polyurea polymer having a hardness (Shore D) of about 45-55, a tensile strength of about 2800-3200 pounds per square inch (psi), a tear resistance of about 500-600 pounds per linear inch (pli) and a percent elongation of about 400-500.

* * * * *